US008959665B1

(12) United States Patent
Garner et al.

(10) Patent No.: US 8,959,665 B1
(45) Date of Patent: Feb. 24, 2015

(54) BOTTOM GARMENT HAVING IMPROVED TUMMY CONTROL

(75) Inventors: Robert Anthony Garner, Greensboro, NC (US); Kathy Farkas, Kansas City, MO (US); Jennifer McKelvie, Prairie Village, KS (US); Ron Sheeley, Lenexa, KS (US); Shirley O. Goodwin, Greensboro, NC (US); Heather L. Collins, Greensboro, NC (US); Denise Rowe, Greensboro, NC (US); Glenda Strickbine, Greensboro, NC (US); Sebrina Hernandez, Greensboro, NC (US); Joyce P. Markwell, Greensboro, NC (US); John Lindquist, Liberty, NC (US)

(73) Assignee: Wrangler Apparel Corp., Wilmington, DE (US)

( * ) Notice: Subject to any disclaimer, the term of this patent is extended or adjusted under 35 U.S.C. 154(b) by 231 days.

(21) Appl. No.: 13/489,814

(22) Filed: Jun. 6, 2012

Related U.S. Application Data

(60) Provisional application No. 61/494,700, filed on Jun. 8, 2011.

(51) Int. Cl.
*A41F 9/02* (2006.01)
*A41F 9/00* (2006.01)

(52) U.S. Cl.
CPC .... *A41F 9/00* (2013.01); *A41F 9/02* (2013.01)
USPC ..... 2/237; 2/236

(58) Field of Classification Search
USPC ..... 2/79, 77, 215, 217, 223, 227, 409, 236, 2/237; 450/94, 95, 100, 101, 104, 107, 450/114–118, 123, 124, 128, 150, 151, 122
See application file for complete search history.

(56) References Cited

U.S. PATENT DOCUMENTS

| | | | | |
|---|---|---|---|---|
| 3,068,871 | A | 12/1962 | Rapp | 128/519 |
| 3,127,896 | A | 4/1964 | Puliafico | 128/519 |
| 3,234,947 | A | 2/1966 | Bergstein | 128/519 |
| 3,246,342 | A | 4/1966 | Pagano | 2/227 |
| 3,678,514 | A * | 7/1972 | Safrit | 2/212 |
| 5,182,815 | A * | 2/1993 | Young | 2/406 |
| 5,535,451 | A | 7/1996 | Tassone et al. | 2/227 |
| 6,035,448 | A * | 3/2000 | Thomson | 2/227 |
| 7,950,069 | B2 * | 5/2011 | Lee | 2/227 |
| 2007/0118954 | A1 * | 5/2007 | Lee | 2/69 |

* cited by examiner

*Primary Examiner* — Gloria Hale
(74) *Attorney, Agent, or Firm* — MacCord Mason PLLC

(57) ABSTRACT

A bottom garment for providing improved appearance to the wearer. The garment includes a front panel; a back panel; and at least one tummy control panel formed of a low-stretch, high pre-tensioned fabric attached to the inside of the front panel beneath the waistband of the front panel. In one embodiment, the low-stretch, high pre-tension fabric is formed of a mesh construction. The front panel may further include at least one pocket assembly.

44 Claims, 9 Drawing Sheets

E F A STYLE 5804

POWERKNIT
WIDTH: 104 inches 264.2 centimeters
WEIGHT: 3.9 oz/sq yd 11.3 oz/lin yd 132.2 grams/m2
STRETCH: 114 x 65 l xw
CONTENT: 82% NYLON 18% SPANDEX
YARN LIST: 70/34 NYLON

280 SPANDEX

Stretch: 114% Wrap direction
65% Fill direction

BOTTOM GARMENT HAVING IMPROVED TUMMY CONTROL

This application claims the benefit of Provisional Application 61/494,700 filed Jun. 8, 2011.

BACKGROUND OF THE INVENTIONS (1) Field of the Inventions

The present inventions relate generally to apparel and, more particularly, to a bottom garment adapted to provide improved tummy support and appearance for the wearer.

(2) Related Art

Individuals diet and exercise in an attempt to shape their bodies. Most wearers find they cannot shape their bodies as desired only by diet and exercise. For many years the fashion industry has developed foundation garments for women worn underneath clothing, for example girdles and panty hosiery. Unfortunately, layers of foundation garments with other clothing can be uncomfortable and also unsightly with some styles of clothing (e.g., those using stretch fabrics).

There has been some effort to produce clothing with built-in foundation garments. For example, U.S. Pat. No. 3,068,871 to R. Rapp illustrates toreador pants with a built-in panty that merely squeezes and holds in portions of the stomach. Further, U.S. Pat. No. 3,127,896 to Puliafico; U.S. Pat. No. 3,234,947 to Bergstein; U.S. Pat. No. 3,246,342 to Pagano; and U.S. Pat. No. 6,035,448 to Thompson describes slacks with built-in girdles that also merely hold in the stomach.

Jeans composed of denim and blends with elastic fibers have been popular sellers because of their comfort and improved styling. However, due to the stretch nature of the material, foundation garments used to offset profile changes are not usually suitable because their outline typically shows through the stretched fabric creating an unappealing affect.

There also has been some effort to produce clothing having a similar function without foundation garment structures. For example, U.S. Pat. No. 5,535,451 to Tassone et al, describes a pants garment wherein the legs are narrowed to squeeze the thighs of a wearer in an effort to urge the buttocks upward. This construction may be uncomfortable and ill-suited for some wearers and provides only marginal benefit in enhancing the user's profile.

Thus, there remains a need for a new and improved bottom garment which provides improved tummy support and appearance to the wearer while, at the same time, provides a level of comfort similar to conventional garments.

SUMMARY OF THE INVENTIONS

The present inventions are directed to a bottom garment for providing improved appearance to the wearer, the garment includes a front panel; a back panel; and at least one tummy control panel formed of a low-stretch, high pre-tensioned fabric attached to the inside of the front panel beneath the waistband of the front panel. In one embodiment, the low-stretch, high pre-tension fabric is formed of a mesh construction. The front panel may further include at least one pocket assembly.

The stretch of the mesh fabric in the fill direction is less than about 200%. Preferably, the stretch of the mesh fabric in the fill direction is between about 15% and about 200%. In one embodiment, the stretch of the mesh fabric in the fill direction is about 65%.

Also, in one embodiment, the stretch of the mesh fabric in the warp direction is greater than the stretch in the fill direction of the fabric forming the front panel. For example, the stretch of the mesh fabric in the warp direction may be about 114%.

Also, in one embodiment, the pre-tension of the mesh fabric in the fill direction is greater than about 5%. Preferably, the pre-tension of the mesh fabric in the fill direction is between about 5% and 30%. For example, the pre-tension of the mesh fabric may be about 20%.

The mesh fabric may be a power knit fabric. In one embodiment, the mesh fabric is a circular knit fabric. Also, the mesh fabric may be constructed from synthetic yarn and elastane yarn. For example, the mesh fabric may be a nylon and spandex fabric. In one embodiment, the mesh fabric is an 82% nylon and 18% spandex fabric.

In one embodiment, the mesh fabric is between about 2 oz/sq yd and about 6 oz/sq yd. For example, the mesh fabric may be about 4 oz./sq yd.

Preferably, the pocket assembly includes a pocket facing and a pocket bag. Also, the front panel may further include a fly assembly. The fly assembly may be selected from the group consisting of zippers, buttons, hook and loop fasteners, hook and eye, snap and string ties. The back panel may further include a hip pocket assembly. The hip pocket assembly may be selected from the group consisting of patch pockets, welt pockets, insert pocket and hidden pockets. The bottom garment may include jeans, pants, culottes, shorts and skirts.

Accordingly, one aspect of the present inventions is to provide a bottom garment for providing improved appearance to the wearer, the garment including: (a) a front panel; (b) a back panel; and (c) at least one tummy control panel formed of a low-stretch, high pre-tensioned fabric attached to the inside of the front panel beneath the waistband of the front panel.

Another aspect of the present inventions is to provide a bottom garment for providing improved appearance to the wearer, the garment including: (a) a front panel; (b) a back panel; (c) at least one tummy control panel formed of a low-stretch, high pre-tensioned fabric attached to the inside of the front panel beneath the waistband of the front panel; and (d) wherein the low-stretch, high pre-tensioned fabric is formed of a mesh construction.

Still another aspect of the present inventions is to provide a bottom garment for providing improved appearance to the wearer, the garment including; (a) a front panel; (b) a back panel; (c) at least one tummy control panel formed of a low-stretch, high pre-tensioned fabric attached to the inside of the front panel beneath the waistband of the front panel; (d) wherein the low-stretch, high pre-tension fabric is formed of a mesh construction; and (e) wherein the front panel further includes at least one pocket assembly.

These and other aspects of the present inventions will become apparent to those skilled in the art after a reading of the following description of the preferred embodiments when considered with the drawings.

DESCRIPTION OF THE PREFERRED EMBODIMENTS

Figure 1:
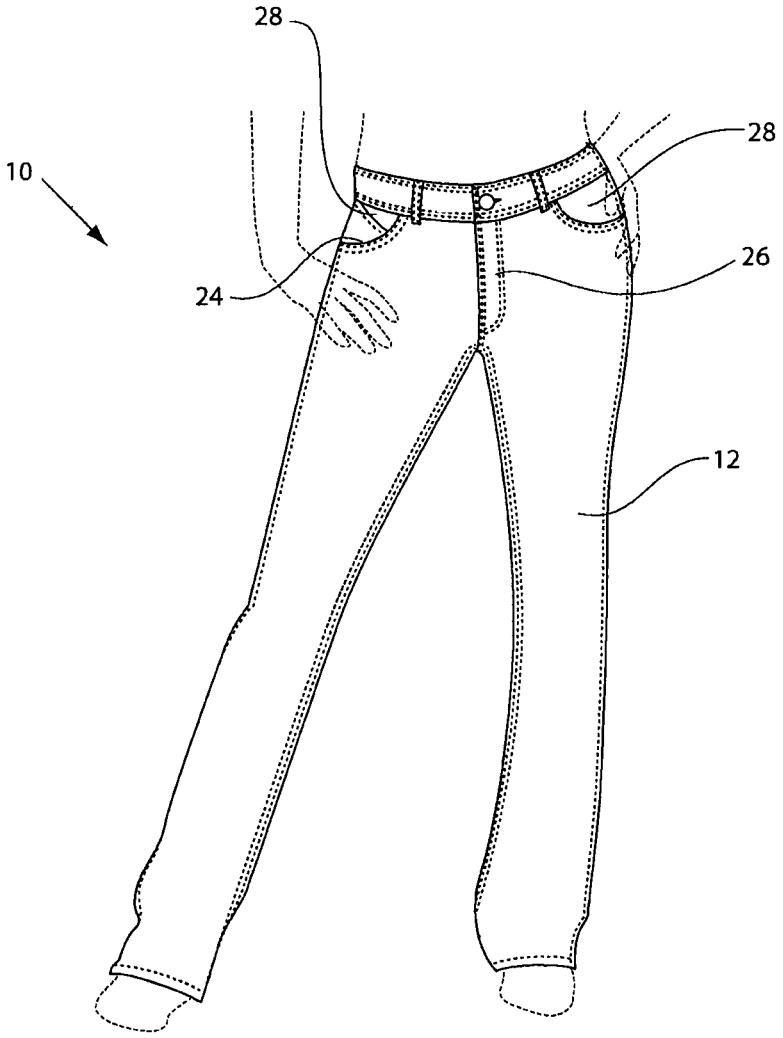
FIG. 1 is a front photograph of a garment constructed according to the present inventions as worn by the user.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing preferred embodiments of the inventions and are not intended to limit the inventions thereto. As best seen in FIG. 1, a bottom garment, generally designated 10, is shown constructed to the present inventions. The bottom garment 10 includes three major sub-assemblies: a front panel 12; a back panel 14; and a pair of opposed tummy control panels 15, 16 attached to the inside of the front panel 12 beneath the waistband 20 of the front panel 12.

Figure 2:
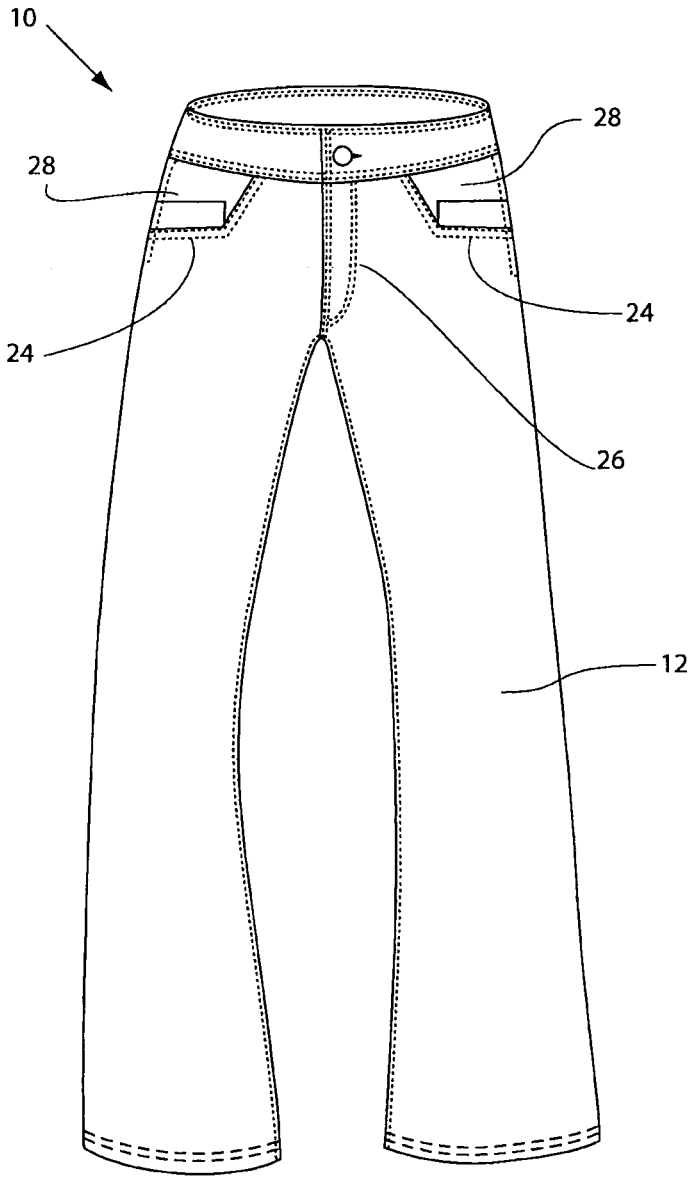
FIG. 2 is a front view of the garment shown in FIG. 1.
Figure 3:
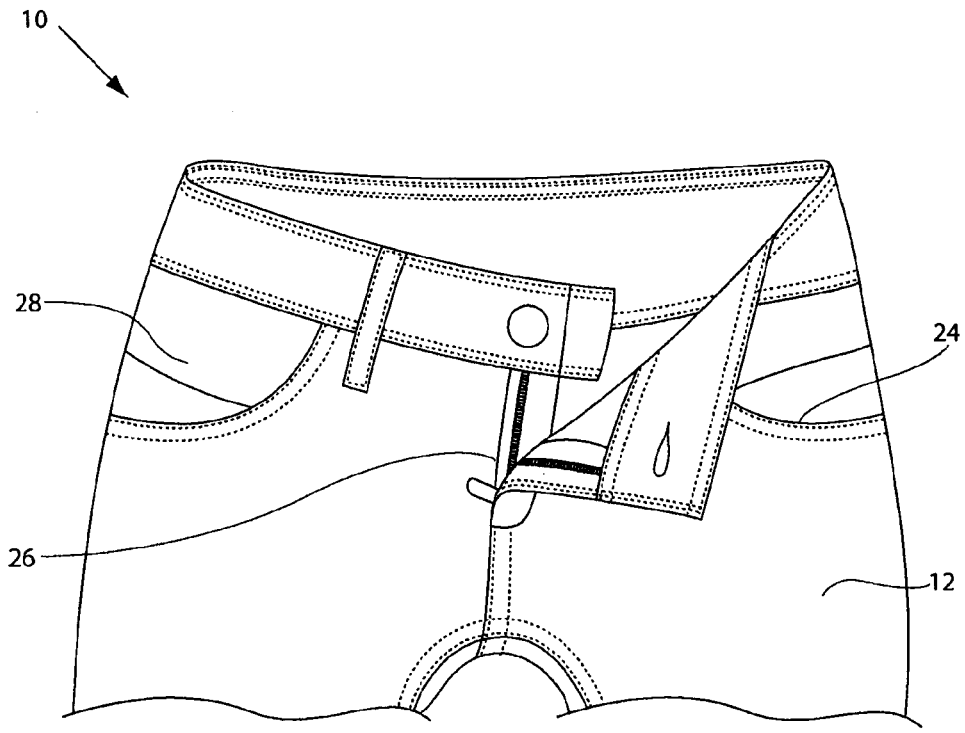
FIG. 3 is an enlarged front view of the garment shown in FIG. 2.

As seen in FIG. 1, there is a front photograph of a bottom garment 10 constructed according the present inventions as worn by a user. The appearance of bottom garment 10 from the front is generally conventional in design. The bottom garment 10 may further include pocket assemblies 24 that may include a pocket facing 28 and a pocket bag. As best seen in FIGS. 2 and 3, the bottom garment 10 may also further include a fly assembly 26 which may consists of zippers, buttons, hook and loop fasteners, hook and eye snap, string ties, and other conventional fly assemblies as shown in FIG. 3 which is an enlarged front view of the bottom garment as shown in FIG. 2.

Figure 4:
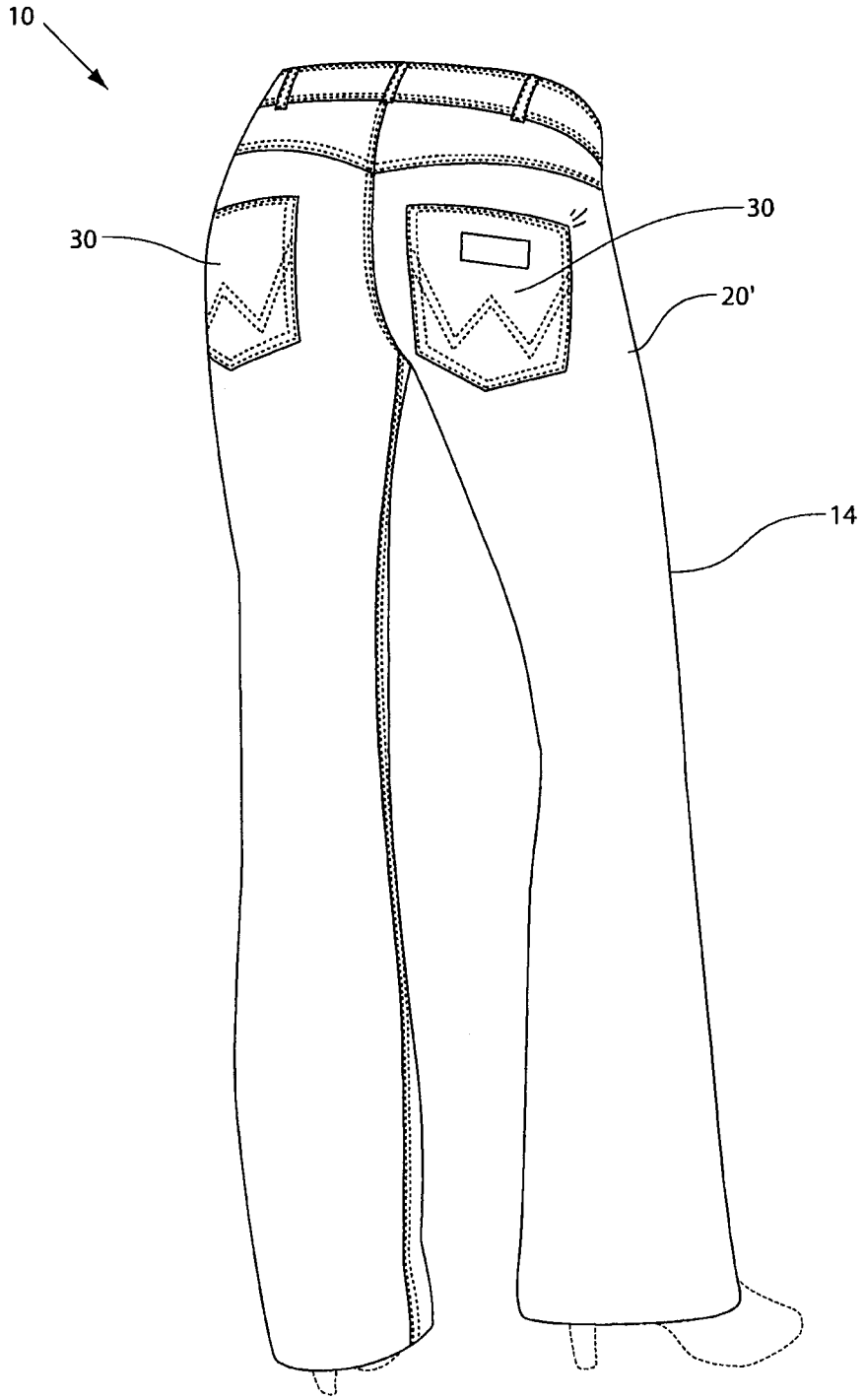
FIG. 4 is a back photograph of the garment shown in FIG. 1 as worn by a user.

Turning next to FIG. 4, there is shown a back photograph of the bottom garment 10 shown in FIG. 1 as worn by the user. The appearance of bottom garment 10 from the rear appears to a casual observer to be generally conventional in design. Back panel 14 may further include a hip pocket assembly 30. Hip pocket assembly 30 may be selected from the group consisting of patch pockets, welt pockets, insert pockets and hidden pockets and other conventional pockets.

Figure 5:
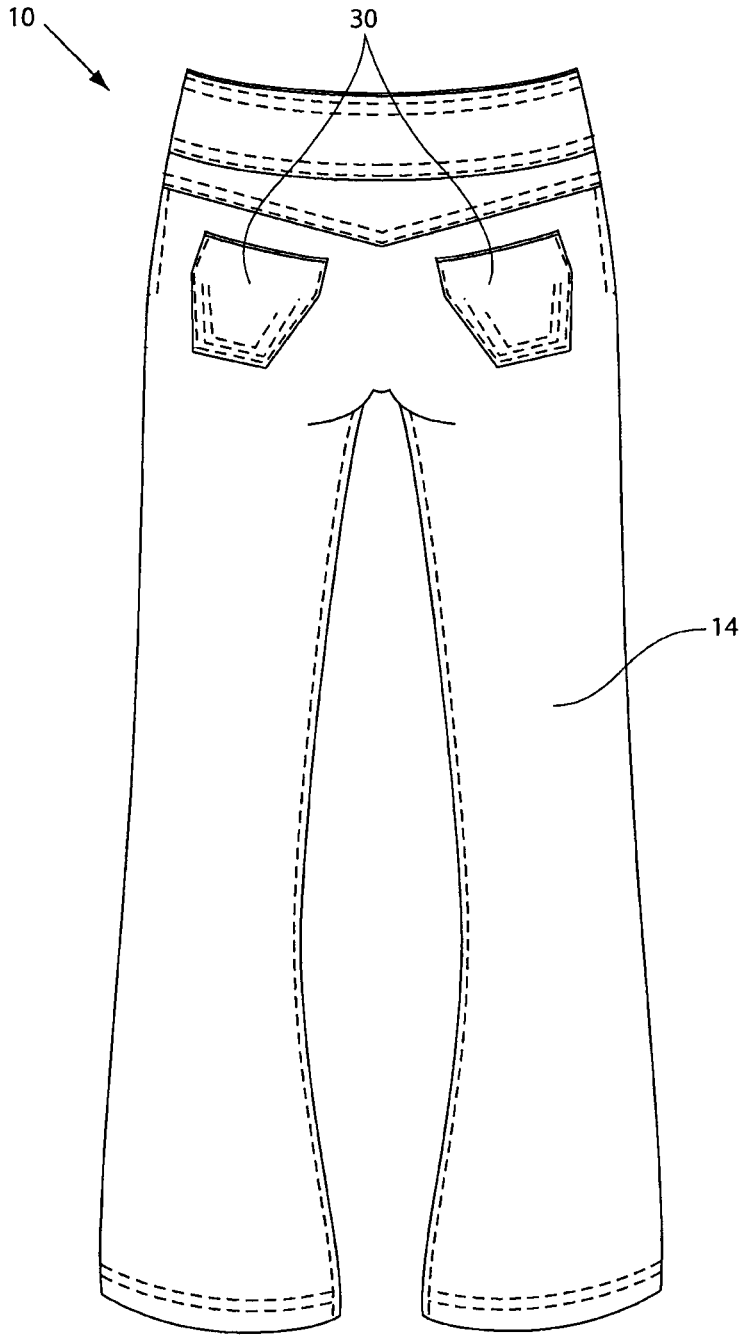
FIG. 5 is a back view of the garment shown in FIG. 4.

As best seen in FIG. 5, the back view of the garment 10 is substantially conventional in appearance.

Figure 6A:
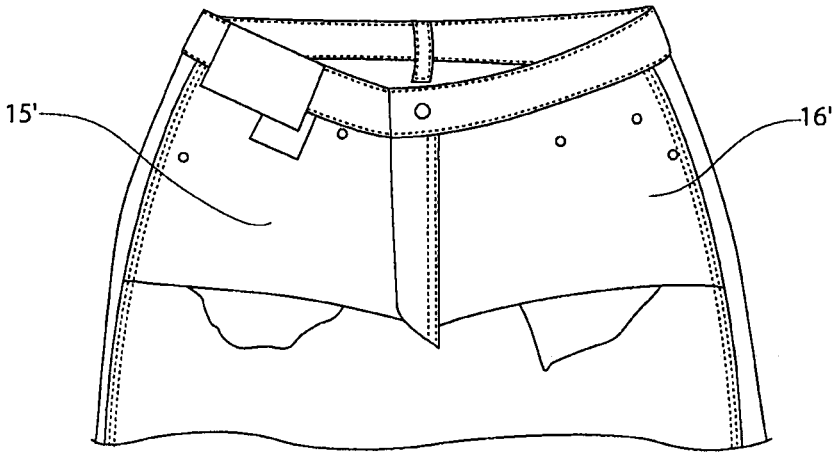
FIGS. 6A and 6B illustrate the construction details of prior art elastic pocket tummy-panels and non-elastic pocket tummy-panels, respectfully.
Figure 6B:
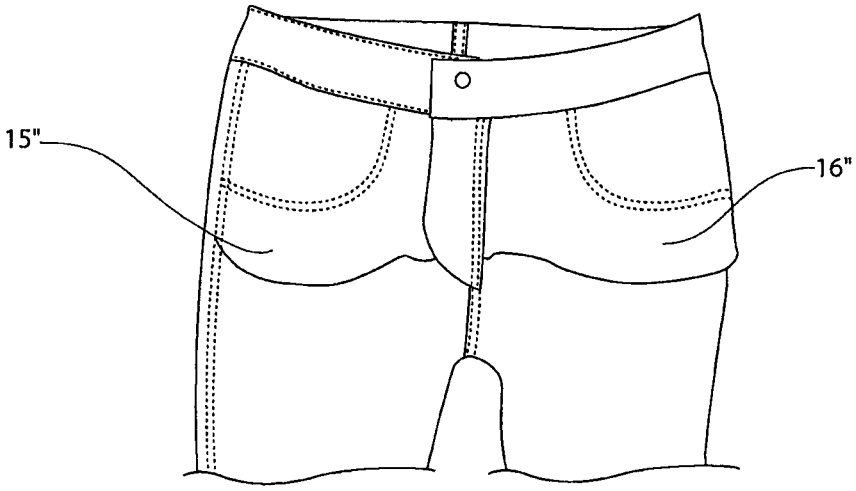

Turning now to FIGS. 6A and 6B, they illustrate the construction details of prior art tummy control panels have utilized both elastic (FIG. 6A) and non-elastic (FIG. 6B) pocket tummy panels. The elastic panels typically stretch too easily, much more easily than the overlying denim. They are not stretched much when the jeans are put on and are never under much tension. Therefore, they do not very effectively contribute to tummy control. On the other hand, the inelastic panels effectively "lock out" the stretch in the front of the jeans but compromise the ability of the garment to conform to the body and to adapt to different body sizes. This is because the elastic tummy control panels are generally less stiff than the denim while inelastic tummy control panels are stiffer than the denim.

Accordingly, a tummy control panel needs to provide more tension than current elastic control panels are able to provide but also the right amount of tension but inelastic control panels have limited ability to conform to the body or to adapt to the different sizes. Another obstacle, even with the right tension of an elastic control panel, is that stretching the fabric in just one direction tends to cause unsightly bunching effect. This bunching effect is more obvious in jeans and similar bottom garments, which are typically less tight than other controlling body wear such as spandex exercise shorts, swim suits and foundation garments. However, if the fabric overlaying the control panel could be stretched in two directions, it might reduce this undesirable effect.

Figure 7:
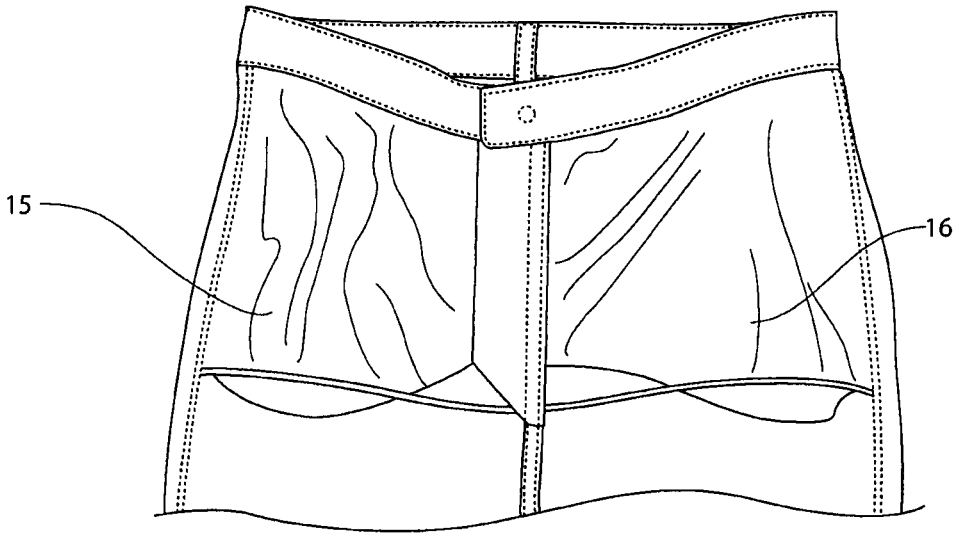
FIG. 7 illustrates the construction details of the present inventions' tummy control panel formed of a low-stretch, high pre-tensioned fabric.

FIG. 7 illustrates the construction details of the present inventions' tummy panel control panels 15, 16 formed of a low-stretch, high pre-tensioned fabric. In one embodiment, it is a mesh fabric that is stretchable in more than one direction. As can be seen, the mesh fabric, tummy control panels 15, 16 are cut shorter than the overlying denim front panel 12 and then stretched to be attached. Both the stiffness and the extension are controlled to optimize the tension. This improves tummy control while maintaining the classic look and feel of the garment.

Preferably, the stretch of the mesh fabric in the fill (horizontal) direction is less than about 200%. Preferably, the stretch of the mesh fabric in the fill direction is between about 15% and about 200%. In one embodiment, the stretch of the mesh fabric in the fill direction is about 65%.

Also, in one embodiment, the stretch of the mesh fabric in the warp (vertical) direction is greater than the stretch in the fill direction of the fabric forming the front panel. For example, the stretch of the mesh fabric in the warp direction may be about 114%.

Also, in one embodiment, the pre-tension of the mesh fabric in the fill direction is greater than about 5%. Preferably, the pre-tension of the mesh fabric in the fill direction is between about 5% and 30%. For example, the pre-tension of the mesh fabric in the fill (horizontal) direction may be about 20%.

The mesh fabric may be a power knit fabric. In one embodiment, the mesh fabric is a circular knit fabric. Also, the mesh fabric may be constructed from synthetic yarn and elastane yarn. For example, the mesh fabric may be a nylon and spandex fabric. In one embodiment, the mesh fabric is an 82% nylon and 18% spandex fabric. In one embodiment, the mesh fabric is between about 2 oz/sq yd and about 6 oz/sq yd. For example, the mesh fabric may be about 4 oz/sq yd.

Figure 8:
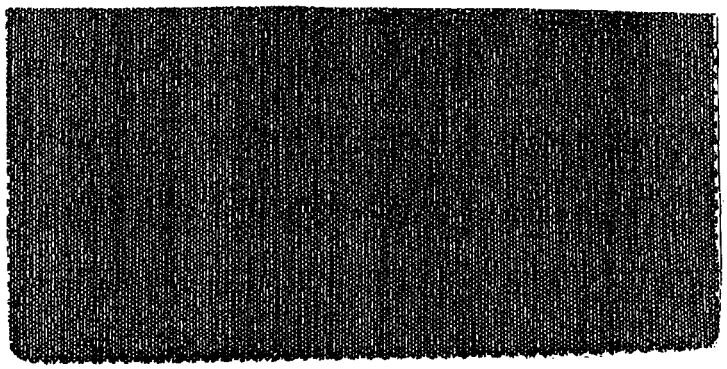
FIG. 8 is an enlarged front view of a sample of the fabric shown in FIG. 7.

As best seen in FIG. 8, there is shown an enlarged front view of a sample of the fabric forming the tummy control panels 15, 16 shown in FIG. 7. One such fabric is Style 5804 (Powerknit) available from Elastic Fabrics of America, Inc. of Greensboro, N.C.

Figure 9:
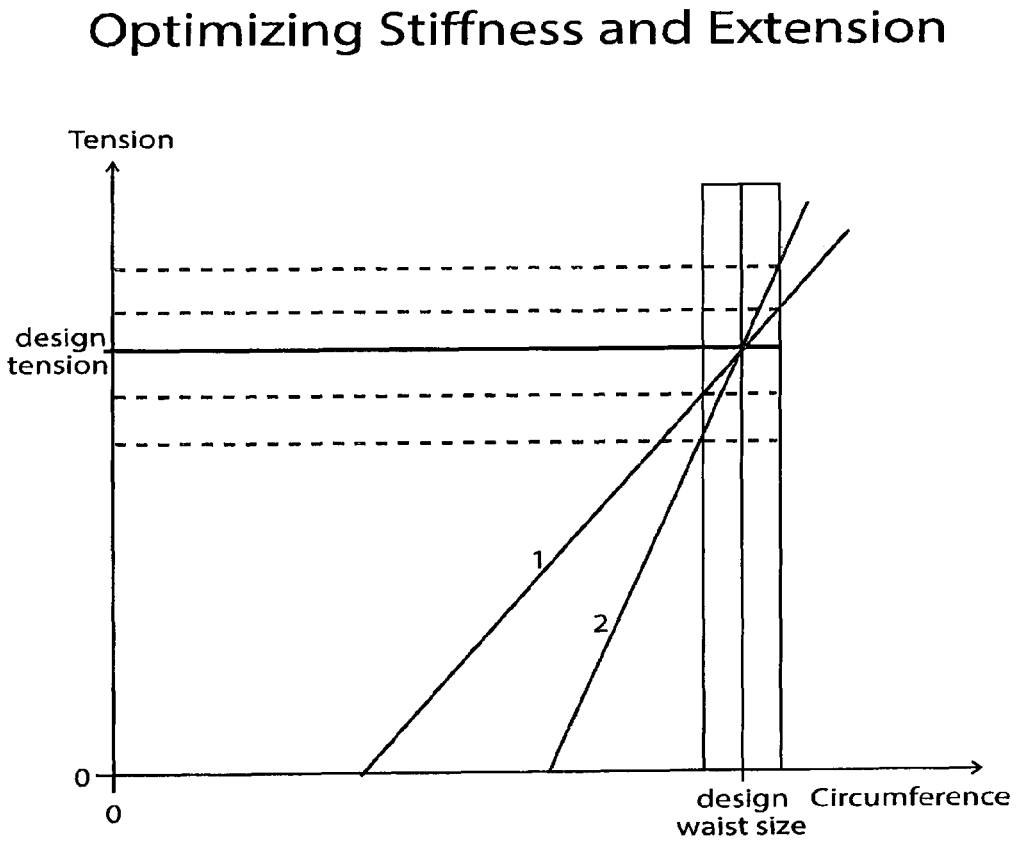
FIG. 9 is a graphical representation of the effect of tummy control panel fabric stiffness on extension for two different low-stretch, high pre-tensioned fabrics.

Finally, turning to FIG. 9, there is shown a graphical representation of the effect of fabric stiffness on extension for two different low-stretch, high pre-tensioned fabrics. Two panels of two different elastic fabrics were pre-tensioned for a wearer of a predetermined design waist size (shown as vertical line). Panel 1 was of a less stiff elastic material that would stretch significantly when the wearer put the garment on Panel 2 was a stiffer elastic material that would stretch less than panel 1 when the wearer put the garment on. As can be seen, by the slope of Line 1, panel 1 has less variation and tension as it is stretched or relaxed on either side of the predetermined design waist size, meaning it is better able to conform to different body shapes than panel 2.

However, if another panel 3 (hypothetical not shown) that was even more elastic than panel 1 but also pre-tensioned for a wearer of a predetermined design waist size (shown as vertical line), the slope of its Line would be sloped still further than Line 1. A garment constructed using panel 3 would appear significantly more deformed on a store hanger than a garment constructed using panel 1 and its appearance might not be acceptable for all buyers. Accordingly, both the amount of pre-tensioning and the stiffness of the tummy control panel fabric must be taken into account.

Certain modifications and improvements will occur to those skilled in the art upon a reading of the foregoing description. By way of example, while one embodiment shown in the above disclosure illustrates a bottom garment 10 that may include jeans, pants, culottes and shorts, it should be clear that the present inventions may be modified to further include skirts. Still other improvements might include varying the tension down the fabric control panel by cutting the panel at an angle; optimizing how far down the fabric control panel extends from the waistband; making the fabric control panel of a number of discreet elastic bands instead of a single flat panel; securing the fabric control panel at the top of the waistband but avoid compromising the horizontal stretch; and using curved elastic panels that becomes straight when they are stretched thereby also lifting the tummy. It should be understood that all such modifications and improvements have been deleted herein for the sake of conciseness and readability but are properly within the scope of the following claims.

We claim:

1. A bottom garment, said garment comprising:

(a) a front panel;

(b) a back panel; and (c) at least one tummy control panel formed of a low-stretch, high pre-tensioned mesh fabric attached to an inside of said front panel beneath a waistband of said front panel, wherein the stretch of said mesh fabric in the warp direction is greater than the stretch in the fill direction of the fabric forming said front panel.

2. The garment according to claim 1, wherein said front panel further includes at least one pocket assembly.

3. The garment according to claim 2, wherein said pocket assembly includes a pocket facing and a pocket bag.

4. The garment according to claim 1, wherein said front panel further includes a fly assembly.

5. The garment according to claim 4, wherein said fly assembly is selected from the group consisting of zippers, buttons, hook and loop fasteners, hook and eye, snap and string ties.

6. The garment according to claim 1, wherein said back panel further includes a hip pocket assembly.

7. The garment according to claim 6, wherein said hip pocket assembly is selected from the group consisting of patch pockets, welt pockets, insert pocket and hidden pockets.

8. The garment according to claim 1, wherein said bottom garment includes jeans, pants, and shorts.

9. A bottom garment, said garment comprising:

(a) a front panel;

(b) a back panel;

(c) at least one tummy control panel formed of a low-stretch, high pre-tensioned mesh fabric attached to an inside of said front panel beneath a waistband of said front panel, wherein the stretch of said mesh fabric in the warp direction is greater than the stretch in the fill direction of the fabric forming said front panel, and (d) wherein said low-stretch, high pre-tensioned fabric is formed of a mesh construction.

10. The garment according to claim 9, wherein the stretch of said mesh fabric in the fill direction is less than about 200%.

11. The garment according to claim 10, wherein the stretch of said mesh fabric in the fill direction is between about 15% and about 200%.

12. The garment according to claim 11, wherein the stretch of said mesh fabric in the fill direction is about 65%.

13. The garment according to claim 9, wherein the stretch of said mesh fabric in the warp direction is about 114%.

14. The garment according to claim 9, wherein the pre-tension of said mesh fabric in the fill direction is greater than about 5%.

15. The garment according to claim 14, wherein the pre-tension of said mesh fabric in the fill direction is between about 5% and 30%.

16. The garment according to claim 15, wherein the pre-tension of said mesh fabric is about 20%.

17. The garment according to claim 9, wherein said mesh fabric is a power knit fabric.

18. The garment according to claim 17, wherein said mesh fabric is a circular knit fabric.

19. The garment according to claim 9, wherein said mesh fabric is constructed from synthetic yarn and elastane yarn.

20. The garment according to claim 19, wherein said mesh fabric is a nylon and spandex fabric.

21. The garment according to claim 20, wherein said mesh fabric is an 82% nylon and 18% spandex fabric.

22. The garment according to claim 9, wherein said mesh fabric is between about 2 oz/sq yd and about 6 oz/sq yd.

23. The garment according to claim 22, wherein said mesh fabric is about 4 oz/sq yd.

24. A bottom garment, said garment comprising:

(a) a front panel;

(b) a back panel;

(c) at least one tummy control panel formed of a low-stretch, high pre-tensioned mesh fabric attached to an inside of said front panel beneath a waistband of said front panel, wherein the stretch of said mesh fabric in the warp direction is greater than the stretch in the fill direction of the fabric forming said front panel;

(d) wherein said low-stretch, high pre-tension fabric is formed of a mesh construction; and (e) wherein said front panel further includes at least one pocket assembly.

25. The garment according to claim 24, wherein said pocket assembly includes a pocket facing and a pocket bag.

26. The garment according to claim 24, wherein said front panel further includes a fly assembly.

27. The garment according to claim 26, wherein said fly assembly is selected from the group consisting of zippers, buttons, hook and loop fasteners, hook and eye, snap and string ties.

28. The garment according to claim 24, wherein said back panel further includes a hip pocket assembly.

29. The garment according to claim 28, wherein said hip pocket assembly is selected from the group consisting of patch pockets, welt pockets, insert pocket and hidden pockets.

30. The garment according to claim 24, wherein said bottom garment includes jeans, pants, and shorts.

31. The garment according to claim 24, wherein the stretch of said mesh fabric in the fill direction is less than about 200%.

32. The garment according to claim 31, wherein the stretch of said mesh fabric in the fill direction is between about 15% and about 200%.

33. The garment according to claim 32, wherein the stretch of said mesh fabric in the fill direction is about 65%.

34. The garment according to claim 24, wherein the stretch of said mesh fabric in the warp direction is about 114%.

35. The garment according to claim 24, wherein the pre-tension of said mesh fabric in the fill direction is greater than about 5%.

36. The garment according to claim 35, wherein the pre-tension of said mesh fabric in the fill direction is between about 5% and 30%.

37. The garment according to claim 36, wherein the pre-tension of said mesh fabric is about 20%.

38. The garment according to claim 24, wherein said mesh fabric is a power knit fabric.

39. The garment according to claim 38, wherein said mesh fabric is a circular knit fabric.

40. The garment according to claim 24, wherein said mesh fabric is constructed from synthetic yarn and elastane yarn.

41. The garment according to claim 40, wherein said mesh fabric is a nylon and spandex fabric.

42. The garment according to claim 41, wherein said mesh fabric is an 82% nylon and 18% spandex fabric.

43. The garment according to claim 24, wherein said mesh fabric is between about 2 oz/sq yd and about 6 oz/sq yd.

44. The garment according to claim 43, wherein said mesh fabric is about 4 oz/sq yd.

* * * * *